US007118200B2

(12) United States Patent
Yamamoto et al.

(10) Patent No.: US 7,118,200 B2
(45) Date of Patent: Oct. 10, 2006

(54) INKJET PRINTER HEAD

(75) Inventors: Ryoichi Yamamoto, Kanagawa (JP); Tsutomu Yokouchi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 274 days.

(21) Appl. No.: 10/766,903

(22) Filed: Jan. 30, 2004

(65) Prior Publication Data

US 2004/0183862 A1 Sep. 23, 2004

(30) Foreign Application Priority Data

Jan. 31, 2003 (JP) ..... 2003-023449

(51) Int. Cl.
*B41J 2/05* (2006.01)

(52) U.S. Cl. ..... 347/62

(58) Field of Classification Search ..... 347/62, 347/204

See application file for complete search history.

(56) References Cited

U.S. PATENT DOCUMENTS 5,966,153 A 10/1999 Mitani et al.
6,354,695 B1 * 3/2002 Kim et al. ..... 347/48
6,648,732 B1 * 11/2003 Pugliese et al. ..... 451/38

FOREIGN PATENT DOCUMENTS

JP 9-174848 7/1997
JP 2000-168088 6/2000

* cited by examiner

*Primary Examiner*—Vip Patel
*Assistant Examiner*—An H. Do
(74) *Attorney, Agent, or Firm*—Whitham, Curtis, Christofferson & Cook, PC

(57) ABSTRACT

The inkjet printer head includes heating elements and ejection nozzles. Each of the heating elements has a heating resistor which is energized by application of an electric current so that a part of ink which is located in proximity to the heating resistor is boiled to form a bubble. The expansion of the formed bubble causes the ink to be ejected as a droplet through each of the ejection nozzles. Each of said heating elements has no protective film disposed between the heating resistor and the ink in which the bubble is to be formed. A thickness of said heating resistor is in a range of from 2 μm to 5 μm.

3 Claims, 2 Drawing Sheets

INKJET PRINTER HEAD

BACKGROUND OF THE INVENTION

This invention relates to an inkjet printer head capable of thermal inkjet printing in which ink is heated to boil by applying an electric current to heating elements and ink droplets are ejected by the expanding force of bubbles formed in the ink.

One of the inkjet printers commonly used today are those capable of thermal inkjet printing in which ink is heated to boil by applying an electric current to heating elements and ink droplets are propelled and ejected by the expanding force of bubbles formed in the ink.

In order to heat the ink in thermal inkjet printing, an electric current needs to be applied to the heating elements for only a very brief period, so the printer head can be constructed in a comparatively simple design and precise printing is yet possible. In addition, the heating elements can be arranged on the substrate on a large scale and at high density. Because of these advantages, thermal inkjet printers are suitable for use not only at homes but also in commercial applications such as textile printing and on-demand printing where continuous printing is performed.

A disadvantage of the thermal inkjet printer head is that the heating elements are prone to be damaged by cavitation that occurs from the extinction of bubbles formed in order to eject ink droplets. In order to prevent this problem, the resistors in the heating elements are commonly protected by superposing an anti-cavitation coat. However, this is not desirable from the viewpoint of the need to achieve very rapid, almost instantaneous, transfer of heat from the heating elements to the ink since the protective coat placed between each heating resistor and the ink slows down the heating of the ink.

JP 9-174848 A proposes a heating element that does need to have a protective coat placed between the heating resistor and the ink in which bubbles are to be formed.

In JP 9-174848 A, thin-film resistors of a Ta—Si—O ternary alloy system having a thickness of 0.1 μm (1000 Å) with the constituent elements defined at proportions within a specified range are used as resistors in heating elements to enable the fabrication of an inkjet printer head that can be energized by application of as many as $10^8$ impulses without being destroyed due to cavitation.

JP 2000-168088 A describes a thermal inkjet printer head that has a two-layered Ta—Si—O film about 7000 Å thick, with a self-oxidizing protective layer formed on top in a thickness of 100–500 Å. The head claims high durability against both cavitation damage and electrolytic corrosion.

As already mentioned, the thermal inkjet printers manufactured today are required to find use not only at homes but also as long-lived and highly durable commercial printers capable of continuous operation as in textile printing and on-demand printing. For use at homes, it has been necessary that the printer should be capable of withstanding the application of at least $10^8$ impulses before the heating elements in the head become no longer operative. However, commercial printers that need to have better durability than home printers are required to use heads with much longer lives than those used on the home printers, for example, heads that can withstand the application of $10^{10}$ impulses.

However, the life of the heating elements proposed in JP 9-174848 A is only about $10^8$ impulses and by no means exceeds $10^{10}$ impulses. Hence, the technology disclosed in JP 9-174848 A has the problem that it cannot manufacture an inkjet printer head that can withstand the application of $10^{10}$ impulses. The thermal inkjet printer head proposed in JP 2000-168088 has the same problem and its cycle life does not exceed $10^{10}$ impulses.

SUMMARY OF THE INVENTION

The present invention has been accomplished in order to solve the aforementioned problems of the prior art and has as an object providing a thermal inkjet printer head having a much longer life than those used on the home printers, for example, a head that can withstand the application of $10^{10}$ impulses.

In order to attain the object described above, the present invention provides an inkjet printer head comprising: heating elements, each having a heating resistor which is energized by application of an electric current so that a part of ink which is located in proximity to the heating resistor is boiled to form a bubble; and ejection nozzles, each being provided for each of the heating elements, wherein expansion of the formed bubble causes the ink to be ejected as a droplet through each of the ejection nozzles, wherein each of the heating elements has no protective film disposed between the heating resistor and the ink in which the bubble is to be formed, and a thickness of the heating resistor is in a range of from 2 μm to 5 μm.

It is preferable that a ratio of volume resistivity of the heating resistor to the thickness is in a range of from 100 Ω to $4\times10^4$ Ω.

It is also preferable that the heating resistor is composed of a Ta—Si—O ternary alloy, a Cr—Si—O ternary alloy or an alloy material made of Ta, Cr, Si and O.

DESCRIPTION OF THE PREFERRED EMBODIMENT

On the pages that follow, the inkjet printer head of the invention is described in detail with reference to the preferred embodiment depicted in the accompanying drawings.

Figure 1A:
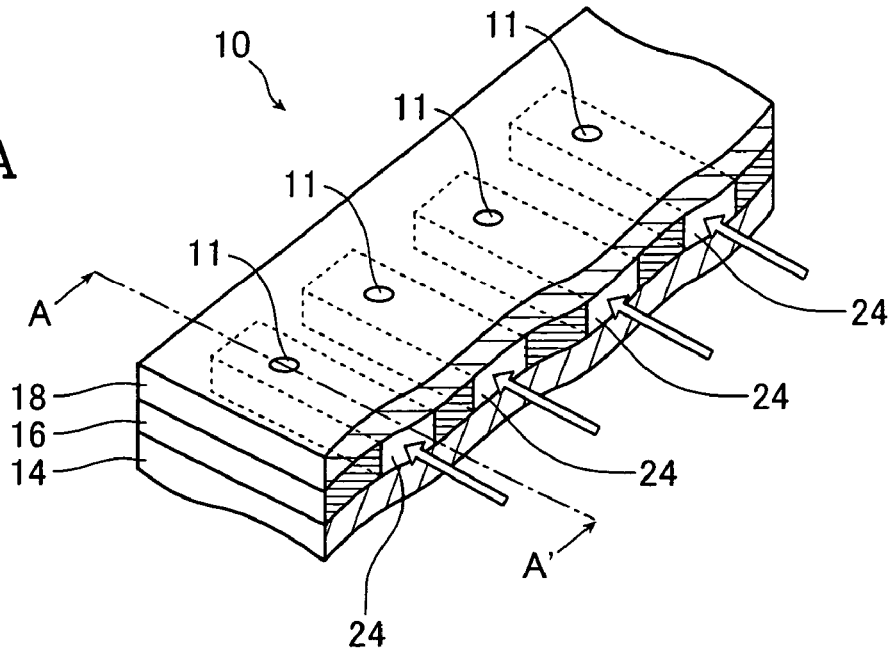
FIG. 1A is a perspective view showing diagrammatically an embodiment of the inkjet printer head of the invention.
Figure 1B:
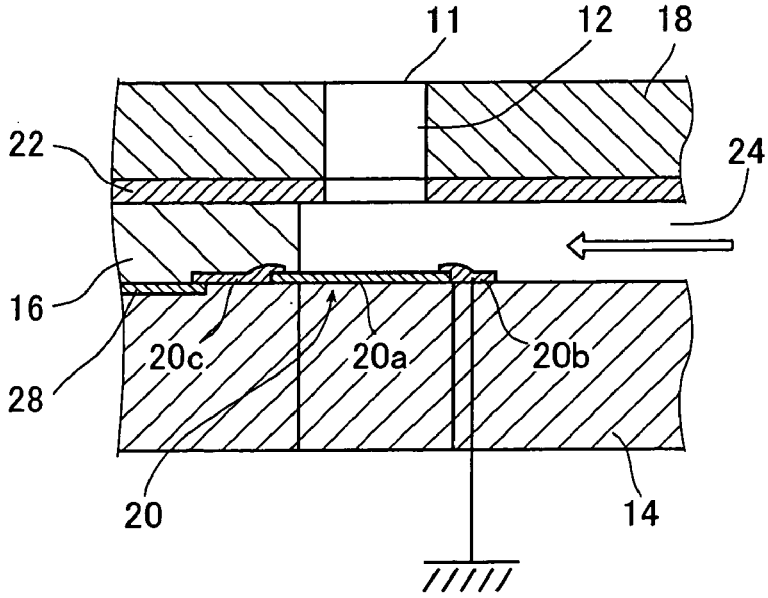
FIG. 1B is section A–A' of the head shown in FIG. 1A.

FIG. 1A is a perspective view showing diagrammatically an exemplary inkjet printer head (hereunder referred to simply as a head) 10 according to the invention and FIG. 1B is section A–A' of the head 10 shown in FIG. 1A.

The head 10 has a number of ejection nozzles 12 formed in one direction at specified intervals and each nozzle has a circular ejection port 11 through which ink is ejected as droplets. Each ejection port 11 has an ejection unit that is so designed that ink droplets are ejected through the ejection port 11.

As shown in FIG. 1A, the head 10 comprises a head substrate 14 that is made of Si, glass, etc. and which is overlaid with a spacer layer 16 which in turn is overlaid with a nozzle plate 18. The head 10 is of a top shooter type which ejects ink droplets in a direction generally perpendicular to the head substrate 14.

As shown in FIG. 1B, a heating element 20 is formed on top of the head substrate 14. The heating element 20 applies thermal energy to ink so that it boils locally to produce bubbles. The head substrate 14 is overlaid with the spacer layer 16 which in turn is overlaid with the nozzle plate 18 to construct the head 10.

The spacer layer 16 and the nozzle plate 18 are bonded together by means of an adhesive layer 22 formed by applying a heat-curable adhesive to the nozzle plate 18.

The spacer layer 16 is provided by first applying a light-sensitive polyimide to the head substrate 14 and patterning the applied polyimide film by dry photo-etching in such a way as to form desired ink supply channels 24. The spacer layer 16 is typically 10 μm thick. The spacer layer 16, the head substrate 14 and the nozzle plate 18 in combination provide wall sides of the ink supply channels 24; the heating elements 20 formed on the head substrate 14 also serve as part of the wall sides of the ink supply channels 24. The ink supply channels 24 communicate with an ink reservoir (not shown) such that ink is kept supplied to the heating elements 20 via the ink supply channels 24.

The heat-curable adhesive is not the only adhesive that can be used to form the adhesive layer 22 which bonds the spacer layer 16 to the nozzle plate 18 and an uv-curable adhesive or a thermoplastic adhesive may also be employed.

The nozzle plate 18 is typically made of Aramid or the like and has a thickness of, say, 10 μm. Extending through the thickness of the nozzle plate 18 is a cylindrical ejection nozzle 12 that has the ejection port 11 open at the ink ejection end and which is located opposite the heating element 20 across the ink supply channel 24.

Aside from Aramid, the nozzle plate 18 may be a polymer film made of PEN (polyether nitrile), polyimide, etc.

The heating element 20 may have a heat insulation layer (not shown) as the bottommost layer which is made of $Ta_2O_5$, $SiO_2$, etc. and overlaid with a heating resistor 20*a* having the composition Ta—Si—O, which in turn is partly overlaid with wiring electrodes 20*b* and 20*c* which are made of Ni and through which voltage is applied to the heating resistor 20*a*. The heat insulation layer, the heating resistor 20*a* and the wiring electrodes 20*b* and 20*c* combine together to form the heating element 20 which, upon application of voltage to the heating resistor 20*a*, generates heat which vaporizes that part of the ink flowing through the ink supply channel 24 which is in the neighborhood of the heating resistor 20*a*. The heating resistors 20*a* may each have a square shape typically measuring 20 μm×20 μm, with the surface covered by a self-oxidizing film typically not thicker than 0.1 μm to provide the heating resistor 20*a* with an overall thickness of 2–3 μm.

Figure 2:
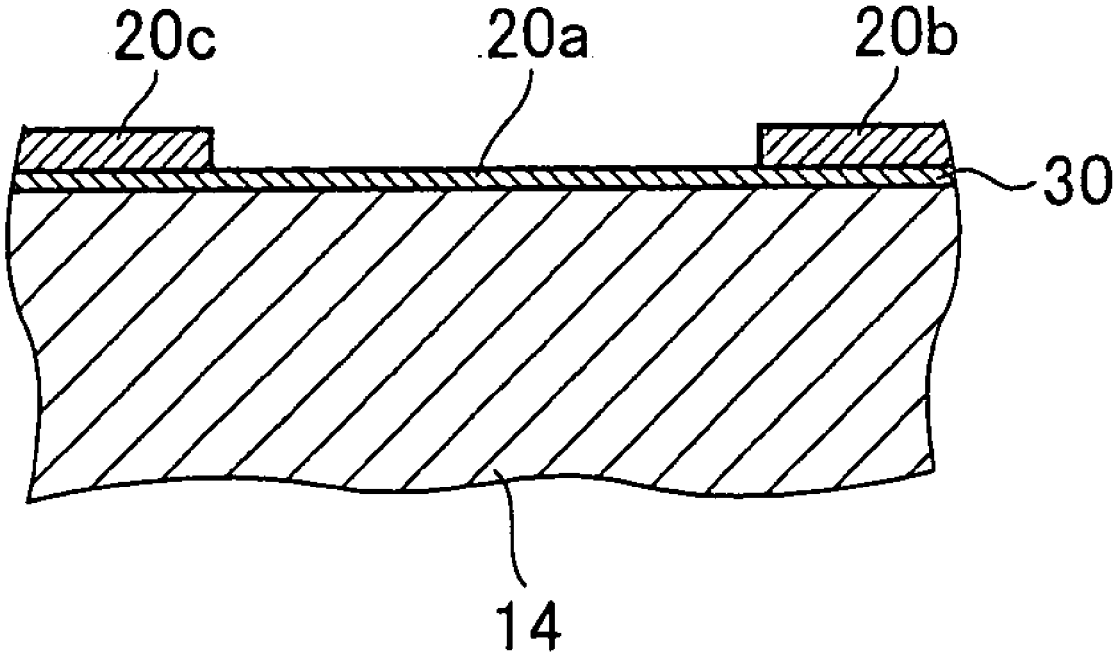
FIG. 2 is a sectional view showing partially enlarged the heating element in FIG. 1B.

FIG. 2 shows partially enlarged the heating element 20.

The heating element 20 comprises the wiring electrodes 20*b* and 20*c* plus the heating resistor 20*a*, with the wiring electrode 20*c* connected to a drive circuit 28 shown in FIG. 1B and supplied with a drive signal for generating heat from the heating element 20. The wiring electrode 20*c* as well as similar wiring electrodes of other ejection units are put together into a common electrode which is connected to the ground.

The head substrate 14 has a heat insulation layer (not shown) as the bottommost layer which is made of $Ta_2O_5$, $SiO_2$, etc. and which in turn is overlaid with a heating resistor layer 30 composed of Ta, Si and O.

The heating resistor layer 30 is typically formed as a film by rf magnetron sputtering using a Ta—Si made but oxide-free target prepared by HIP sintering.

Just prior to start of film formation, the base pressure within the vacuum chamber is adjusted to $10^{-5}$ Pa and thereafter the pressure of the gas atmosphere consisting of Ar and $O_2$ (the atomic percent of $O_2$ relative to that of Ar is 0.1–0.2) is adjusted to 0.6 Pa and rf magnetron sputtering is performed to input an energy of 15–50 kW/m$^2$, thereby forming a film without heating and cooling the head substrate 14.

Subsequently, an electrode layer is formed by high-speed sputtering in an intense magnetic field and photo-etched to pattern wiring electrodes 20*b* and 20*c*, thereby fabricating the heating element 20 having the heating resistor 20*a* exposed on the surface.

Formed on the outermost surface of the heating resistor 20*a* is a self-oxidizing coat made of a Ta—Si—O ternary alloy. The self-oxidizing coat has high resistance to cavitation and can prevent electrolytic corrosion. The heating resistor 20*a* is characterized in that its overall thickness including the self-oxidizing coat is 2–5 μm and because of this feature, the printer head of the invention can withstand energization by application of up to $10^{10}$ impulses.

Since the heating resistor 20*a* is a thick film (2–5 μm), it tends to have lower resistance. Therefore, if the ratio of the resistivity of the heating resistor 20*a* to its thickness is made smaller than 100 Ω, there arises the need to apply a large amount of electric current in order to supply just a small quantity of thermal energy sufficient to vaporize the ink and form bubbles. As a result, the width, thickness and other sizes of the wiring electrodes 20*b* and 20*c* must be restricted and the configuration of the drive circuit 28 designed in such a way as to permit the passage of that large amount of electric current. But then the cost of the drive circuit 28 increases and no commercially feasible inkjet printer head can be offered. On the other hand, if the ratio of the resistivity of the heating resistor 20*a* to its thickness is made greater than $4\times10^4$ Ω, the resistance of the heating resistor 20*a* increases so that the drive voltage, hence the cost of the drive circuit 28, increases and no commercially feasible inkjet printer head can be offered.

For these reasons, the ratio of the resistivity of the heating resistor 20*a* to its thickness is preferably in the range of 100–$4\times10^4$ Ω. In order to calculate the resistance of the heating resistor 20*a*, its resistivity is multiplied by the distance over which an electric current flows through it and the product is divided by its cross-sectional area through which the current flows.

Consequently, the upper limit of the resistance of a square heating element 20*a* measuring, say, 20 μm×20 μm can be set at $4\times10^4$ Ω and assuming that a power of 1 W is required for ink ejection, the drive voltage can be set at 200 V which is the upper limit of the practical range.

EXAMPLES

Four samples of inkjet printer head of the top shooter type were fabricated with the thickness of heating resistor varied between 0.75 and 5 μm (Examples 1 and 2 and Comparative Examples 1 and 2). The other dimensions of the printer heads were the same: heating element size, 20 μm square; height of spacer layer 16, 10 μm; thickness of nozzle plate 18, 10 μm; diameter of ejection port 11, 15 μm. The life of each sample was evaluated. Heating resistors thicker than 5 μm could not be fabricated in a consistent manner.

The heating resistor layers were deposited by rf magnetron sputtering with a sputter power of 1 kw in an Ar/$O_2$ atmosphere ($O_2$ to Ar atm. % ratio of 0.2) using a Ta—Si made but oxide-free target prepared by HIP sintering. In order to prepare heating resistors of desired thicknesses, the rate of resistor deposition by rf magnetron sputtering was preliminarily determined and the sputter time was controlled on the basis of the thus determined deposition rate.

The resistance of each heating resistor was directly measured and the number of impulses that could be applied up to the time when the rate of ink droplet ejection had decreased by 10% was set as the life of the heating resistor.

The following table 1 lists the measured thicknesses, resistances and lives of the heating resistors under test.

TABLE 1

| | Thickness of heating resistor (μm) | Resistance (kΩ) | Life (impulses) |
|---|---|---|---|
| Example 1 | 2 | 5 | $2 \times 10^{10}$ |
| Example 2 | 5 | 2 | $5 \times 10^{10}$ |
| Comparative Example 1 | 0.75 | 13 | $4 \times 10^{8}$ |
| Comparative Example 2 | 1.5 | 10 | $5 \times 10^{9}$ |

As Table 1 shows, the life of heating resistors in terms of the number of impulses applied exceeded $10^{10}$ when their thickness was between 2 and 5 μm. Below 2 μm, the life was smaller than $10^{10}$.

The reason would be as follows: even if the self-oxidizing coat on the surface layer of the heating resistor is locally damaged by cavitation and the underlying portion of the heating resistor becomes exposed, a sufficient thickness of self-oxidizing coat to prevent electrolytic corrosion is formed within a short time by the heat generated for ink ejection and the underlying heating resistor can still function to eject ink droplets. The heating resistor being energized by application of impulses is chipped by cavitation in the direction of its depth and only after the size of bubbles formed by heat generation decreases substantially on account of the heating resistor having locally failed to exhibit the heat generating action for bubble formation, it can be said that the life of the heating resistor has come to an end. Therefore, in order to ensure that the life of the heating resistor as expressed by the number of impulses that can be applied is more than $10^{10}$, the thickness of the heating resistor needs to be at least 2 μm.

On the other hand, if the heating resistor is thicker than 5 μm, an increased stress will build up within the resistor which may either come off from the heat substrate or crack, making consistent fabrication of heating resistors impossible. Even if heating resistors thicker than 5 μm can be fabricated, their resistance is lowered by the increased thickness and consequently, as already mentioned, the sizes of the wiring electrodes and the configuration of the drive circuit must be determined considering the voltage and current to be applied; as a result, the cost of the drive circuit increases and no commercially feasible inkjet printer heads can be offered.

In the foregoing embodiment, the heating resistors were formed of a Ta—Si—O ternary alloy. This is not the sole case of the invention and any alloy materials may be employed as long as they have high resistance to electrolytic corrosion and cavitation. For example, a Cr—Si—O ternary alloy may be used to make the heating resistor. In this case, the desired coat may be formed by rf magnetron sputtering using a Cr—Si made but oxide-free target prepared by HIP sintering.

The heating resistor may even be composed of an alloy material comprising Ta, Cr, Si and O.

While the inkjet printer head of the invention has been described above in detail, the invention is by no means limited to the foregoing embodiment and it goes without saying that various improvements and modifications can be made without departing from the spirit and scope of the invention. For example, the inkjet printer head may be of a side shooter type which ejects ink droplets in a direction parallel to the head substrate having heating elements formed thereon.

As described above in detail, the inkjet printer head of the invention is characterized in that the heating elements it employs have no protective film disposed between the heating resistor and the ink in which bubbles are to be formed, with the thickness of the heating resistor being in the range of 2–5 μm. Having these features, the inkjet printer head of the invention has a by far extended service life than that in common household printers and can withstand energization by the application of, say, up to $10^{10}$ impulses.

What is claimed is:

1. An inkjet printer head comprising:

heating elements, each having a heating resistor which is energized by application of an electric current so that a part of ink which is located in proximity to the heating resistor is boiled to form a bubble; and ejection nozzles, each being provided for each of said heating elements, wherein expansion of the formed bubble causes the ink to be ejected as a droplet through each of said ejection nozzles, wherein each of said heating elements has no protective film disposed between said heating resistor and the ink in which the bubble is to be formed, and a thickness of said heating resistor is in a range of from 2 μm to 5 μm.

2. The inkjet printer head according to claim 1, wherein a ratio of volume resistivity of said heating resistor to said thickness is in a range of from 100 Ω to $4\times10^{4}$ Ω.

3. The inkjet printer head according to claim 1, wherein said heating resistor is composed of Ta—Si—C ternary alloy or an alloy made of Ta, Cr, Si and O.

* * * * *

UNITED STATES PATENT AND TRADEMARK OFFICE

CERTIFICATE OF CORRECTION

PATENT NO. : 7,118,200 B2
APPLICATION NO. : 10/766903
DATED : October 10, 2006
INVENTOR(S) : Yamamoto et al.

It is certified that error appears in the above-identified patent and that said Letters Patent is hereby corrected as shown below:

In the bottom of column 6 please reeplace claim 3 which reads, -- 3. The inkjet printer head according to claim 1, wherein said heating resistor is composed of Ta-Si-O ternary alloy, a Cr-Si-O ternary alloy or an alloy made of Ta, Cr, Si and O. --

Signed and Sealed this

Thirtieth Day of January, 2007

JON W. DUDAS
*Director of the United States Patent and Trademark Office*